United States Patent [19]

Skinner et al.

[11] Patent Number: 4,474,157

[45] Date of Patent: Oct. 2, 1984

[54] FUEL INJECTION PUMPING APPARATUS

[75] Inventors: Robert T. J. Skinner, High Wycombe; Dorian F. Mowbray, Burnham, both of England

[73] Assignee: Lucas Industries Limited, Birmingham, England

[21] Appl. No.: 324,602

[22] Filed: Nov. 24, 1981

[30] Foreign Application Priority Data

Dec. 31, 1980 [GB] United Kingdom ..... 8041545

[51] Int. Cl.[3] ..... F02B 19/02; F02M 59/28

[52] U.S. Cl. ..... 123/450; 123/387; 417/462

[58] Field of Search ..... 123/450, 387; 417/462, 417/253, 206

[56] References Cited

U.S. PATENT DOCUMENTS

| | | | |
|---|---|---|---|
| 4,055,387 | 10/1977 | Potter | 417/462 |
| 4,067,304 | 1/1978 | Potter | 417/462 |
| 4,098,249 | 7/1978 | Mowbray | 123/450 |
| 4,299,542 | 11/1981 | Potter | 417/462 |
| 4,334,831 | 6/1982 | Baxter | 417/462 |
| 4,362,140 | 12/1982 | Jefferson | 123/387 |

*Primary Examiner*—Charles J. Myhre
*Assistant Examiner*—Carl Stuart Miller

[57] ABSTRACT

A fuel injection pumping apparatus of the rotary distributor type has pumping plungers located in a bore in the distributor member. A cup shaped member surrounds the distributor member and has slots in which are located cam followers. The cup shaped member is connected to a drive shaft as also is the distributor member. Slidable within the cup shaped member is an annular member which has a tapered internal surface which can register with complementary surfaces on the followers or on the plungers to limit the outward movement of the plungers.

1 Claim, 5 Drawing Figures

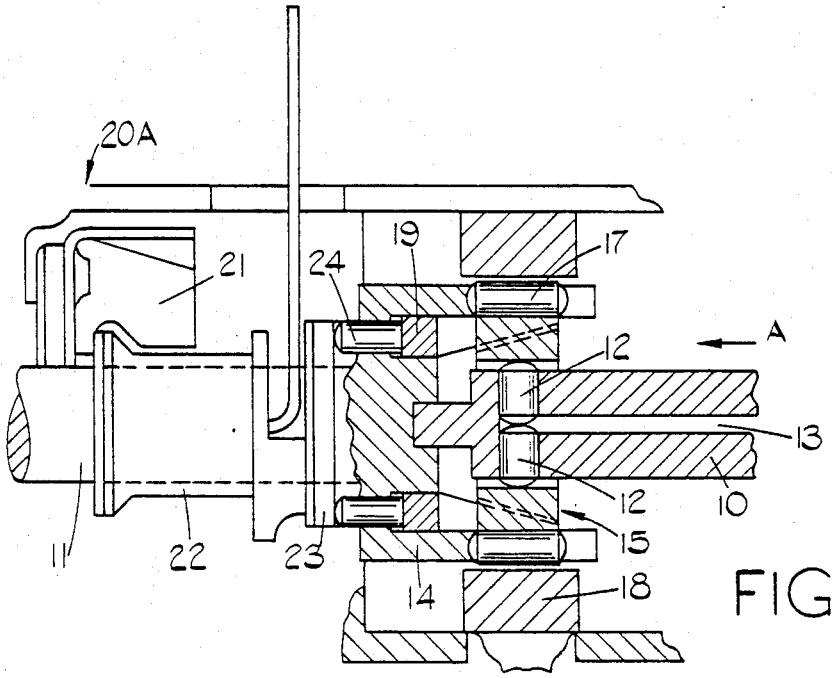
FIG. 1.
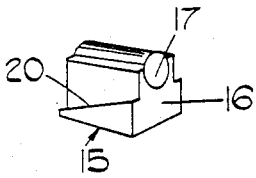
FIG. 3.
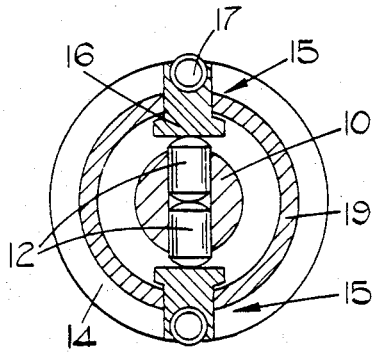
FIG. 2.
FIG. 4.
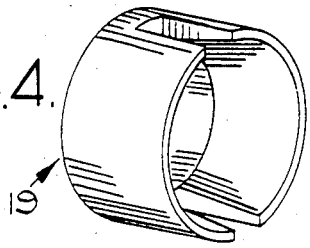
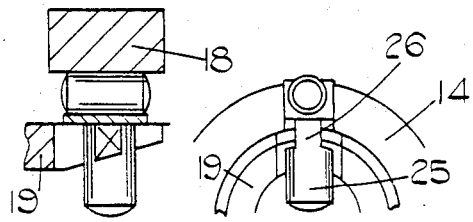
FIG. 5.

FUEL INJECTION PUMPING APPARATUS

This invention relates to fuel injection pumping apparatus of the kind comprising a rotary distributor member mounted in a housing, a transverse bore in the distributor member and a pair of plungers therein, cam followers located at the outer ends of the plungers for engagement with cam lobes formed on the internal peripheral surface of a cam ring, passage means in the distributor member for conveying fuel to and from the bore and a cup shaped member secured to a drive shaft of the apparatus, the cup shaped member being positioned about the distributor member and having slots therein to accomodate the followers, the distributor member being driven from the drive shaft.

The cup shaped member relieves the distributor member of the loads created when the followers engage the cam lobes. In the apparatus of the aforesaid kind it is usual to provide stops to limit the extent of outward movement of the plungers. In some cases the stops are fixed during use of the apparatus but in many cases it is desirable to be able to vary the settings of the stops while the apparatus is in use. This may be for the purpose of varying the maximum amount of fuel which can be supplied to the associated engine in accordance with for example speed, or it may be for the purpose of controlling the amount of fuel pumped by the apparatus throughout the speed and fuel quantity range of the engine. In some instances it is required that the stop should be able to withstand the force acting on the associated plunger whilst the other plunger is delivering fuel to the associated engine as for example when one plunger is moved inwardly before the other to provide a reduced initial rate of fuel supply to the engine.

The object of the present invention is to provide such an apparatus in a simple and convenient form.

According to the invention an apparatus of the kind specified comprises an annular member axially slidable within the cup shaped member and in sliding engagement with the inside surface thereof and inclined surfaces defined on said member for engagement with complementary surfaces on said followers or plungers thereby to limit the outward movement of the plungers, and means for moving said annular member axially relative to the cup shaped member.

Examples of apparatus in accordance with the invention will now be described with reference to the accompanying drawings in which:

FIG. 1 is a part sectional side elevation of one example of the apparatus;

FIG. 2 is an end view in the direction of the arrow A in FIG. 1,

FIGS. 3 and 4 are respective views of parts of the apparatus in FIG. 1 and FIG. 5 shows two views of an alternative form of the apparatus.

Referring to FIGS. 1, 2 and 3 of the drawings the apparatus comprises a distributor member 10 which is mounted for rotation within a surrounding body and which is driven by means of a tongue and groove connection from a drive shaft 11. In use, the drive shaft 11 is driven in timed relationship with the engine.

The distributor member is provided with a transverse bore in which is mounted a pair of pumping plungers 12. Moreover, the bore containing the plungers communicates with a passage 13 through which fuel can flow to and from the bore in a manner well known in the art.

Surrounding the distributor member is a cup shaped member 14 which is integral with the drive shaft 11 and formed in the cup shaped member are a pair of slots which accomodate cam followers 15 respectively. Each cam follower comprises a shoe 16 which mounts a roller 17. The rollers are engagable with cam lobes formed on the internal peripheral surface of an annular cam ring 18 which surrounds the cup shaped member 14. As the drive shaft rotates inward movement is imparted to the plungers 12 through the intermediary of the cam followers, and fuel displaced from the bore containing the plungers flows to outlet ports in turn. The outlet ports are connected to the injection nozzles respectively of the associated engine.

In order to control the outward movement of the plungers 12, there is provided an annular member 19 which is shown in perspective view in FIG. 4. The member is located within the cup shaped member and is in axial sliding engagement with the internal peripheral surface thereof. As shown in FIG. 4, the member 19 is provided with a pair of slots through which extend the cam followers. Moreover, the internal peripheral surface of the member 19 is inclined and the inclined surface co-operates with complementary inclined surfaces 20 formed on the side faces of the shoes 16, to limit the extent of outward movement of the shoes and thereby the plungers 12.

As the member 19 is moved axially within the cup shaped member 14, the extent of outward movement of the plungers is varied and in the example shown in FIG. 1, as the cup-shaped member is moved towards the right the extent of outward movement of the plungers is reduced.

The axial position of the annular member 19 is determined in the example of FIG. 1, by means of a governor mechanism part of which is indicated at 20A. The mechanism includes a centrifugal weight 21 which upon outward movement under the action of centrifugal force, imparts axial movement to a sleeve 22 against the action of a governor spring not shown. The sleeve 22 includes a flange portion 23 which is coupled to the member 19 through at least a pair of push pins 24 slidable within apertures formed in the base wall of the cup shaped member 14.

In the example shown in FIG. 1 the plungers 12 are moved inwardly at the same time but it can be arranged by suitable positioning of the surfaces 20 on one of the shoes, that the plunger associated with that shoe moves further in the outward direction than the other plunger. If this is the case then the one plunger will be moved inwardly before the other and the fuel pressure acting upon the other plunger will impose a force which is resisted by the annular member 19 supported by the cup shaped member 14.

Turning now to FIG. 5, the complementary surfaces on the shoes 16 are omitted and instead the surfaces are defined upon the plungers 25. Each plunger therefore has a reduced portion 26 which extends through the slots formed in the annular member 19.

An alternative construction (not shown) is a modification of the arrangement shown in FIG. 5. In this case a slot is formed in each plunger and the base wall of the slot is inclined. The annular member 19 is provided with a projection which extends through the aforesaid slot, the internal surface of the projection being inclined for co-operation with the base wall of the slot.

In a modification of the arrangement which is shown in FIG. 1, the annular member 19 is assembled the opposite way round in the cup shaped member. Moreover, the shoes are also turned through 180° so that the annular member must be moved towards the right to increase the extent of outward movement of the plungers. The actuating mechanism for the member may comprise hydraulic pistons located within suitable cylinders accomodated within the portion of the housing which supports the distributor member.

In each of the examples described it may be necessary to provide a return spring to ensure that the annular member is maintained in contact with its actuating mechanism. In all the examples it will be noted that once the plungers have started to move inwardly so that the complementary surfaces on the annular member 19 and the shoes or plungers, have separated, the setting of the annular member can be effected very readily.

I claim:

1. A fuel injection pumping apparatus comprising a rotary distributor member mounted in a housing, a transverse bore in the distributor member and a pair of plungers therein, cam followers located at the outer ends of the plungers for engagement with cam lobes formed on the internal peripheral surface of a cam ring, passage means in the distributor member for conveying fuel to and from the bore, a cup shaped member secured to a drive shaft of the apparatus, the cup shaped member being positioned about the distributor member and having slots therein to accommodate the followers, the distributor member being driven from the drive shaft, an annular member of cup shaped form axially slidable within the cup shaped member and in sliding engagement with the inside surface thereof, inclined surfaces defined on said annular member for engagement with complementary surfaces on said followers or plungers thereby to limit the outward movement of the plungers, said cup shaped member having a base wall and apertures in the base wall and pins extending through said apertures respectively, and means including a further member which is axially movable and which is in engagement with said pins for moving said annular member axially relative to the cup shaped member.

* * * * *